United States Patent [19]

Pinsonneault

[11] Patent Number: 4,788,795

[45] Date of Patent: Dec. 6, 1988

[54] VEHICLE WINDOW OPERATING SYSTEM

[75] Inventor: Jacques E. Pinsonneault, Mt. Clemens, Mich.

[73] Assignee: American Motors Corporation, Detroit, Mich.

[21] Appl. No.: 86,292

[22] Filed: Aug. 10, 1987

[51] Int. Cl.[4] ..... E05F 11/48

[52] U.S. Cl. ..... 49/352; 49/349; 49/362; 49/502

[58] Field of Search ..... 49/352, 360, 362, 349, 49/502

[56] References Cited

U.S. PATENT DOCUMENTS 3,028,157 4/1962 Batley ..... 49/352
3,703,053 11/1972 De Rees et al. ..... 49/375 X
4,663,886 5/1987 Nakamura et al. ..... 49/360
4,716,682 1/1988 De Rees ..... 49/502

*Primary Examiner*—Joseph Falk
*Attorney, Agent, or Firm*—Brooks & Kushman

[57] ABSTRACT

A vehicle window operating system (10) disclosed for use in combination with a vehicle body (12) having an outer contour (13) comprises an elongated guide member (30), a guide follower (34) and a regulator (38) including a control member (40) that acts along the longitudinal axis of the guide member for displacing the guide follower along the guide member to provide window panel (24) stability along its path of displacement and also to provide flush alignment of the window panel with the vehicle contour.

4 Claims, 3 Drawing Sheets

VEHICLE WINDOW OPERATING SYSTEM

TECHNICAL FIELD

This operation relates to a vehicle window operating mechanism wherein the vehicle window is movable between open and closed positions.

BACKGROUND ART

Vehicle window operating systems have been used in vehicles for a long time, typically in vehicle doors. Conventional window systems include a guide for vertical movement of the window between a closed or raised position and an open or lowered position where the window is stored below a window opening between sheet metal panels that define the door. A regulating means, typically located on the inside panel of the door below the window opening, is used to regulate displacement of the window position between raised and lowered positions.

Conventional framed window systems require a channel for receiving the edges of the window glass about the opening, and since friction must be minimized to maintain easy displacement of the window, conventional compression seals cannot be used to assure sealing of the window about the opening in the closed position. Moreover, both framed and unframed known window units are not well adapted to stabilize the window which tends to "blow out" of position especially at higher vehicle speeds that create a vacuum on the outside surface of the window glass.

Furthermore, conventional framed and unframed vehicle window installations require an overlapping area of window panel which extends below the belt line at least for connection to conventional window operating linkages, and in the case of unframed windows, for support of the window by apparatus below the window opening. Such additional glass not only increases the weight and bulk of the window and its operating mechanism, but it also requires a higher belt line to fully receive the window in its retracted position.

U.S. Pat. No. 3,703,053 to DeRees et al for a Vehicle Window Installation discloses a vehicle window system including a guide member secured to a vehicle body, a follower movable along the guide and a regulating mechanism. A window glass is fixedly attached to the follower but the regulator has a control member which is attached to the bottom edge of the window at a position spaced apart from the guide to raise and lower the window, and introduces disorienting, off-axis moments with respect to the guide when the window is raised or lowered.

U.S. Pat. No. 3,028,157 to George C. Bately for Window Regulator discloses a vehicle window regulating system including a guide fixedly mounted in a vehicle body, a follower located in the guide and a window regulating device. The guide extends along the edge of the window panel such that it contacts both the inside and outside surfaces of the window glass.

DISCLOSURE OF THE INVENTION

An object of the present invention is to provide an improved vehicle window operating system which provides a flush mounting arrangement of an exterior side of the window with respect to vehicle contour. It is also an object to provide increased window stability over conventional glass regulating systems. Such stability also permits the use of a compression glass seal along the edge of the vehicle opening, which provides an improved sealing condition over the typical glass guide type seal often used in conventional vehicle window installations. It is also an object to provide greater styling freedom by minimizing the height of the belt line required to accommodate the retracted window glass as well as reducing the size, bulk and weight of the window and its operating mechanism.

In carrying out the above objects, the vehicle window operating mechanism is used in combination with a vehicle body having an outer contour and an opening in the contour penetrating the contour and enclosed by a peripheral edge defined at least in part by a body panel. The opening has upper and lower limits and a window panel is shaped to close the opening. The window panel has an interior surface and an exterior surface.

The improvement comprises an elongated guide member having a length greater than the distance between the upper limit and the lower limit of the peripheral edge of the window opening. A mount mounts the guide member to the body panel so that the guide member extends across the opening. A guide follower is slidably entrained on the guide member. A connector secures the guide follower to the window panel on the interior surface of the window panel. An actuator displaces the guide follower along the guide member and includes a control member secured to the guide follower within the guide member. The window panel is stabily supported along its path of displacement across the opening when the window panel is in a fixed position and also when the window panel is being displaced.

In the preferred embodiment, the elongated guide member is configured complementary to the vehicle contour intermediate the upper and lower limits of the opening whereby the exterior surface of the window panel is positioned in flush alignment with the vehicle contour at the peripheral edge about the opening, the exterior surface being continuous with the contour so as to be substantially coplanar at the edge. The elongated guide member includes a longitudinal channel to receive the elongated guide follower. The guide follower has an elongated shape which generally complements the shape of the guide member. The guide follower also has a cross sectional shape adapted for slidable movement along the longitudinal channel. A mechanical fastener and aperture connection mounts the guide to the vehicle body. In the most preferred embodiment, the connector for securing the guide follower to the window panel comprises a bonding agent although a mechanical fastener can also be used.

The actuator includes a control member coupled to the guide follower for longitudinal movement of the follower and window panel on the guide member. In the preferred embodiment, the guide member includes a track for receiving the control member wherein the track is in communication with the longitudinal channel. This structure allows the control member to be connected to the follower member. In the most preferred embodiment, the actuator is a belt drive regulator including a drive belt connected to the follower member, or the actuator is a cable drive regulator including a drive cable connected to the follower member.

The objects, features, and advantages of the present invention are readily apparent from the following detailed description of the best mode for carrying out the invention when read in connection with the accompanying drawings.

BEST MODE FOR CARRYING OUT THE INVENTION

Figure 1:
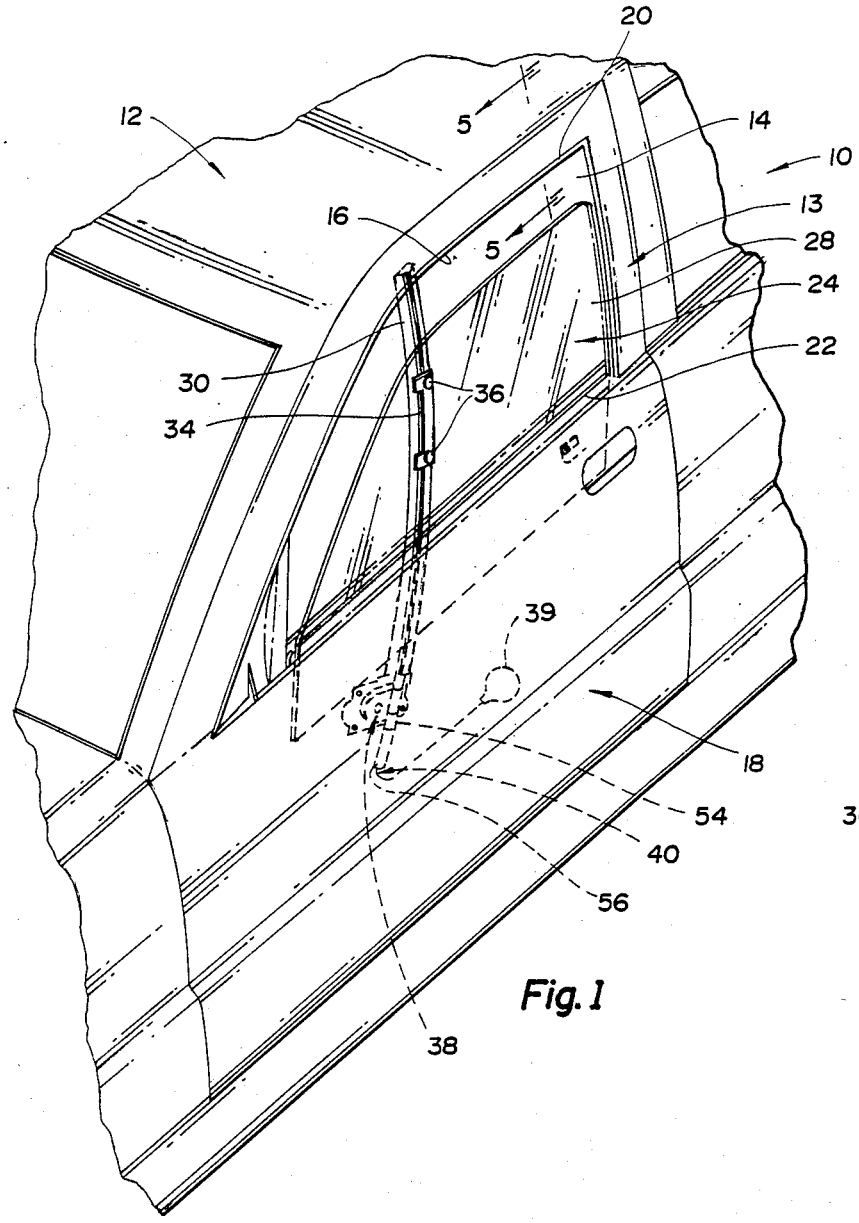
FIG. 1 is a partial perspective view of a vehicle body having an outer contour including a window operating system constructed in accordance with the present invention.

Referring to FIG. 1 of the drawings, a vehicle window operating system constructed in accordance with the present invention is generally indicated by reference numeral 10 and is shown for use in combination with a vehicle body 12 having an outer contour 13 defined by the cross sectional shape of the side of the vehicle. An opening 14 penetrates the contour and the opening is enclosed by a peripheral edge 16 defined at least in part by a body panel 18, shown here as a vehicle door. The opening 14 has upper and lower limits 20, 22 and a window panel 24 is shaped to close the opening. The window panel 24 has an interior surface 26 and an exterior surface 28. As is hereinafter more fully described, the vehicle window operating system 10 provides a stable support for the window panel 24 and also a flush mounting arrangement of the exterior surface 28 of the window with the vehicle contour 13 at the peripheral edge 16. In this mounting, the exterior surface 28 of window panel 24 is continuous with the contour 13 so as to be substantially coplanar at the edge 16.

With further reference to FIG. 1, the vehicle window operating system 10 comprises a guide member 30 of an elongated shape having a length greater than the distance between the upper limit 20 and the lower limit 22 of the peripheral edge 16 of the window opening 14. A mount 32 mounts the guide member 30 to the body panel or door 18 so that the guide member extends across the opening 14. In the embodiment shown, the guide member 30 is mounted to the door 18 on both sides of opening 14. On doors without full frames, guide member 30 is mounted on one side of opening 14 within the door 18. A guide follower 34 is slidably entrained on the guide member 30 for controlled longitudinal movement on the guide member. In the preferred embodiment, the guide member 30 includes a longitudinal channel 31 adapted to receive the guide follower 34.

A connector 36 secures the guide follower 34 to the window panel 24 on the interior surface 26 of the window panel. Regulator 38 is operable for displacing the guide follower 34 along the guide member 30. The regulator 38 includes a control member 40 secured to the guide follower 34 within the guide member 30 to control the movement of the follower 34 and window panel 24 along a path of displacement between a raised or closed position of the window and a lowered or open position of the window. The regulator 38 includes an actuator 39 for displacing the control member 40 along the longitudinal axis of the guide member. By the aforementioned structure, the window panel 24 is continually stabily supported along its path of displacement across the opening 14 when the window panel is in a fixed position and also when the window panel is being displaced.

Figure 5:
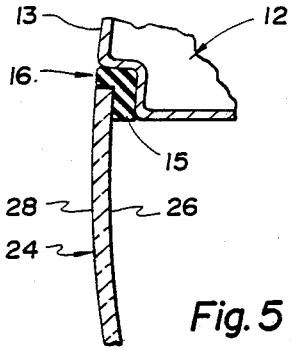
FIG. 5 is a partial sectional view taken along the directions of lines 5—5 in FIG. 1 showing coplanar flush mounting of a window panel with the vehicle contour.

In the preferred embodiment, as shown in FIG. 1, the elongated guide member 30 is configured complementary to the vehicle contour intermediate the upper and lower limits 20, 22 whereby the exterior surface 28 of the window panel 24 is positionable in flush alignment with the contour 13, that is, where the exterior window surface 28 lies in a substantially continuous, coplanar arrangement with the vehicle contour 13 at the peripheral edge 16 about the opening 14 as best seen in FIG. 5. As also shown in FIG. 5, the window panel 24 presses against a compression seal 15 secured about the peripheral edge 16 of the opening 14.

Figure 2:
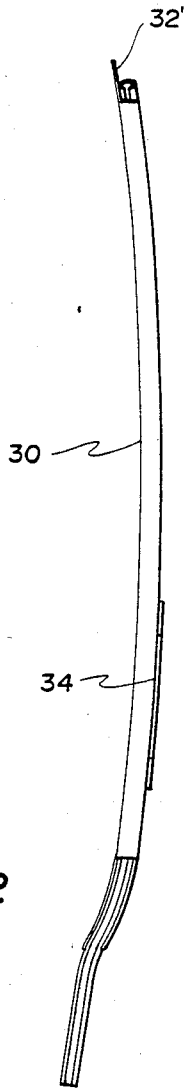
FIG. 2 is a side elevational view of a guide member illustrating its arcuate shape.
Figure 3:
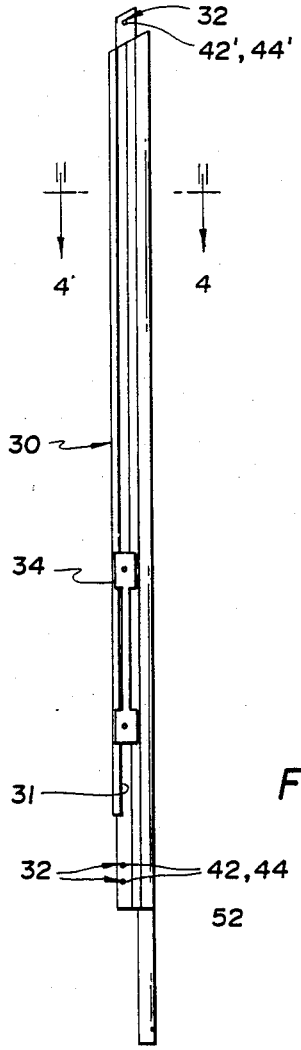
FIG. 3 is an elevational view of the guide member and a follower thereon.
Figure 4:
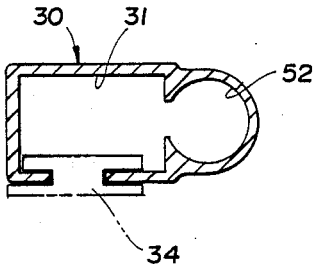
FIG. 4 is partial sectional view taken along the direction of lines 4—4 in FIG. 3 illustrating the construction of the guide member.

FIGS. 2, 3 and 4 illustrate the preferred embodiment of the guide member 30 being of an arcuate shape complementary to the contour 13. The guide member 30 includes the longitudinal channel 31 for receiving the guide follower 34 which is best seen in FIG. 4. Preferably, the guide follower 34 is of an elongated shape which generally complements the arcuate shape of the guide member 30 to facilitate slidable movement on the guide member. Guide follower 34 also has a cross sectional shape adapted for slidable movement along the longitudinal channel 31.

As senn in FIG. 3, mount 32 comprises a mechanical fastener 42 and aperture connection 44. This mounting arrangement allows the elongated guide member 30 to be secured to the vehicle door 18 after the window panel 24 has been positioned to close the opening 14 to assure flush alignment of the window panel with respect to the vehicle contour 13, proper peripheral alignment of the window panel within the peripheral edge 16 and also to facilitate improved production assembly procedure over conventional window systems.

Figure 6:
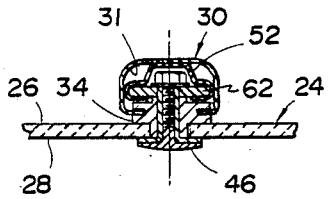
FIG. 6 is a partial sectional plan view of the window panel attached to a guide follower by mechanical fasteners and attached to a belt drive regulator.
Figure 7:
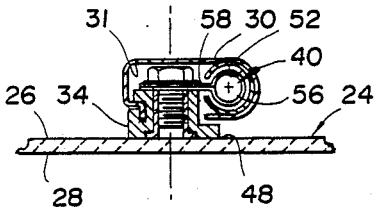
FIG. 7 is a partial sectional plan view of a window panel bonded to a guide follower by a bonding agent and attached to a cable drive regulator.
Figure 8:
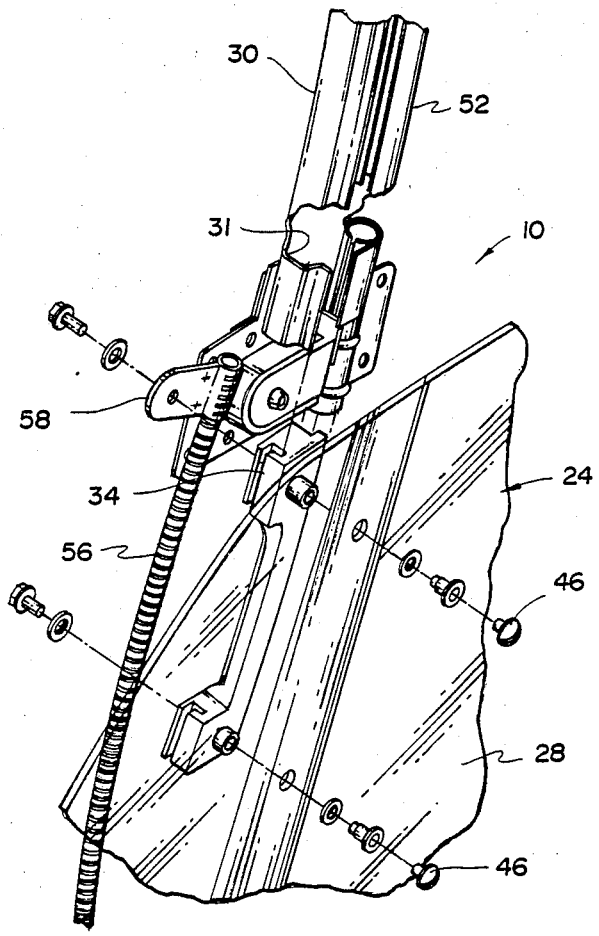
FIG. 8 is a partial perspective view illustrating the assembly of vehicle window operating system utilizing the cable drive regulator.

FIGS. 6 and 8 illustrate the window panel 24 as being connected to the elongated follower 34 by a mechanical fastener 46 shown as a nut and bolt arrangement. Other mechanical fastening arrangements are equally suitable for this application so long as the interior surface 26 of the window panel 24 is secured to the guide follower 34. For example, as shown in FIG. 7, window panel 24 may be attached to the elongated guide follower 34 by a bonding agent 48. Utilization of the bonding agent 48 provides for hidden attachment of the window panel 24 to the guide follower 34 which results in a less cluttered appearance on the exterior surface 28 of the window panel.

Regulator 38, illustrated by hidden lines in FIG. 1, is mounted to the vehicle door 18 and is shown including control member 40 being a flexible elongated member coupled to the guide follower 34 and an actuator 39 for displacing the control member 10 for controlling longitudinal movement of the follower 34 and window panel 24 on the guide member 30. The guide member 30 shown includes a track 52 in communication with the adjacent channel 31 for receiving the flexible elongated control member 40, best seen in FIGS. 4, 6 and 7.

FIG. 8 illustrates a preferred assembly of the vehicle window operating system 10 in which the window panel 24 is secured to the guide follower 34 by mechanical fasteners 46. Also shown is the fastening arrangement of the flexible elongated control member 40 to the follower 34 and the mounting of the follower 34 to guide member 30.

With continued reference to FIG. 8, the regulator 38 is a cable drive regulator 54 and includes the control member 40 in the form of a drive cable 56 connected by connector clamp 58 to guide follower 34. Another type of regulator 38 which can be used is a belt drive regulator which includes the control member 40 in the form of a drive belt 62 connected to the follower member 34. This connection is best seen in FIG. 6 where the interior surface 26 of window panel 24 is shown as being fastened to the guide follower 34 by mechanical fasteners 46. As illustrated, drive belt 62 travels along channel 31 of guide member 30 eliminating the need for track 52.

In FIG. 7, window panel 24 is shown bonded to the guide follower 34 by bonding agent 48. The guide follower 34 is slidably mounted on the guide member 30 as by engagement of the enlarged portion 64 of the follower within channel 31. The track 52 communicates with channel 31 so that connector clamp 58 couples the drive cable 56 with the follower 34 to allow the drive cable 56 and guide follower 34 to act along the axis of the guide member 30 for controlled displacement of the follower and window panel 24 along the guide.

From the structure disclosed, it can be seen that the control member 40 acts along the longitudinal axis of the guide member 30 to move the window panel 24 up or down. Guide member 30 also provides the support for the window panel 24 as the window is moved between open and closed positions across the opening 14. This support eliminates blow out associated with the vacuum created on the exterior surface 28 of the window panel 24 at high vehicle speeds. By the limitation of displacement forces only along the longitudinal axis of the guide member 30 and with the constant support of the window along the guide member, accuracy of alignment of the window panel in the closed, open or intermediate positions is assured as no moments are created by an application of off-axis forces during the movement of the window panel to twist or rotate it as with conventional systems.

Although FIG. 1 illustrates a vehicle door 18 in which the window panel 24 is sealingly engaged in flush alignment with the vehicle contour 13 at the peripheral edge 16 of the opening 14 defined by a portion of the door 18, the vehicle window operating system 10 can be utilized on vehicle doors having no window framing where the exterior surface 28 of the window panel 24 is positioned in continuous coplanar alignment with the vehicle contour at the peripheral edge 16 being defined by a roof panel. This latter mentioned application is highly desirable on convertible top type vehicles.

While the best mode for carrying out the invention has been described in detail, those familiar with the art to which this invention relates will recognize the various alternative designs and embodiments for practicing the invention as defined by the following claims.

What is claimed is:

1. In combination with a vehicle body having an outer contour, and an opening in said vehicle contour penetrating the contour and enclosed by a peripheral edge defined at least in part by a body panel, said opening having upper and lower limits, and a window panel shaped to close said opening and having an interior surface and an exterior surface, the improvement comprising:

an elongated guide member including a track and having a length greater than the distance between said upper limit and the lower limtis of said peripheral edge of said window opening;

a mount for mounting said guide member to said body panel so that said guide member extends across said opening;

a guide follower being slidably entrained on said guide member;

a connector for securing said guide follower to said window panel on the interior surface of said window panel; and a regulator for displacing said guide follower along said guide member, and said regulator including a control member secured to said guide follower within said guide member;

said control member being defined by a flexible elongated drive member connected to said guide follower and being received within said track for longitudinal movement of said guide follower and window panel on said guide member;

whereby said window panel is stably supported along its path of displacement across said opening when said window panel is in a fixed position and also when said window panel is being displaced.

2. The invention as defined in claim 1 wherein said track is of a shape corresponding to the cross sectional shape of said flexible member, said track being in communication with said guide member to allow said drive member to be connected to said guide follower.

3. The invention as defined in claim 2 wherein said regulator is a cable drive regulator including a drive cable connected to said guide follower.

4. The invention as defined in claim 1 wherein said regulator is a belt drive regulator including a drive belt connected to said follower member.

* * * * *

UNITED STATES PATENT AND TRADEMARK OFFICE

CERTIFICATE OF CORRECTION

PATENT NO. : 4,788,795

DATED : December 6, 1988

INVENTOR(S) : Jacques E. Pinsonneault

It is certified that error appears in the above-identified patent and that said Letters Patent is hereby corrected as shown below:

Column 1, line 5, "operation" should read -- invention --.

Column 4, line 38, "senn" should read -- seen --.

Column 6, line 21, "limtis" should read -- limits --.

Signed and Sealed this

Eleventh Day of April, 1989

*Attest:*

DONALD J. QUIGG

*Attesting Officer*

*Commissioner of Patents and Trademarks*